US006639361B2

(12) United States Patent
Takeda et al.

(10) Patent No.: US 6,639,361 B2
(45) Date of Patent: Oct. 28, 2003

(54) METAL HALIDE LAMP

(75) Inventors: Kazuo Takeda, Osaka (JP); Yoshiharu Nishiura, Shiga (JP); Shiki Nakayama, Osaka (JP); Takashi Yamamoto, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 54 days.

(21) Appl. No.: 09/578,232

(22) Filed: May 24, 2000

(65) Prior Publication Data

US 2002/0185975 A1 Dec. 12, 2002

(30) Foreign Application Priority Data

May 25, 1999 (JP) ..... 11-144694

(51) Int. Cl.[7] ..... H01J 61/073

(52) U.S. Cl. ..... 313/574; 313/620; 313/623; 313/331

(58) Field of Search ..... 313/574, 620, 313/623, 331, 326

(56) References Cited

U.S. PATENT DOCUMENTS

| | | | |
|---|---|---|---|
| 2,765,420 | A | 10/1956 | Martt |
| 4,105,908 | A | 8/1978 | Harding et al. |
| 4,475,061 | A | 10/1984 | Van de Weijer et al. |
| 4,539,511 | A | 9/1985 | Denbigh et al. |
| 4,651,048 | A | 3/1987 | Liebe |
| 4,808,881 | A | 2/1989 | Kariya et al. |
| 4,910,430 | A | 3/1990 | Ito et al. |

FOREIGN PATENT DOCUMENTS

| | | |
|---|---|---|
| EP | 0 286 247 | 12/1988 |
| EP | 0 639 853 | 2/1995 |
| EP | 1 056 115 | 5/1999 |
| JP | 48-25383 | 4/1973 |
| JP | 55-136449 | 10/1980 |
| JP | 57-78763 | 5/1982 |
| JP | 58-59555 | 4/1983 |
| JP | 61-245457 | 10/1986 |
| JP | 62-283543 | 12/1987 |
| JP | 2-94352 | 4/1990 |
| JP | 4-99662 | 8/1992 |
| JP | 6-196131 | 7/1994 |
| JP | 7-21981 | 1/1995 |
| JP | 7-94142 | 4/1995 |
| JP | 7-240184 | 9/1995 |
| JP | 9-92204 | 4/1997 |
| JP | 9-129178 | 5/1997 |
| JP | 10-134765 | 5/1998 |
| JP | 10-134768 | 5/1998 |
| JP | 11-96973 | 4/1999 |

(List continued on next page.)

*Primary Examiner*—Ashok Patel
(74) *Attorney, Agent, or Firm*—Merchant & Gould P.C.

(57) ABSTRACT

A metal halide lamp using a ceramic arc tube in which less lamp flickering occurs, the flux maintenance factor during the lifetime is high and the possibility of lamp break-off is low. The metal halide lamp includes an arc tube 1 in which iodide pellet of metal halide is filled, and a pair of electrodes are arranged in the ceramic arc tube so that the electrode coils are facing each other. The following relation is satisfied:

$$0.00056 \times W + 0.061 \leqq \alpha \leqq 0.0056 \times W + 1.61$$

where α (in mm) denotes a length of the portion of the electrode bar protruding from the end face of the electrode coil and W (in Watt) denotes the lamp power.

3 Claims, 5 Drawing Sheets

U.S. PATENT DOCUMENTS 5,142,195 A * 8/1992 Heider et al. ..... 313/623
5,357,167 A 10/1994 Mathews et al.
5,424,609 A 6/1995 Geven et al.
5,552,670 A 9/1996 Heider et al.
5,557,169 A 9/1996 Van Lierop et al.
5,598,063 A * 1/1997 Mathews et al. ..... 313/623
5,654,606 A 8/1997 Weijtens et al.
5,680,000 A 10/1997 Zuk et al.
5,708,328 A 1/1998 Mathews et al.
5,742,124 A 4/1998 Kees et al.
5,742,125 A 4/1998 Ruigrock
5,751,111 A 5/1998 Stoffels et al.
5,856,726 A 1/1999 Evans et al.
5,905,341 A 5/1999 Ikeuchi et al.
5,973,453 A 10/1999 Van de Vliet et al.
6,137,230 A 10/2000 Born et al.
6,232,719 B1 * 5/2001 Kaneko et al. ..... 313/623
6,362,569 B1 3/2002 Wijenberg et al.

* cited by examiner

METAL HALIDE LAMP

FIELD OF THE INVENTION

The present invention relates to a metal halide lamp with a ceramic arc tube.

BACKGROUND OF THE INVENTION

In a metal halide lamp having a ceramic arc tube, a material of the arc tube and a filled metal react less than those in a metal halide lamp having a quartz arc tube, which has generally been used so far. Therefore, a stable lifetime property is expected.

Conventionally, this kind of metal halide lamp having an arc tube that is a translucent alumina tube closed with an insulating ceramic cap or a conductive cap at both ends is known (see, for example, JP No. 62-283543 A).

Another known metal halide lamp is disclosed in, for example, JP No. 6-196131A. In this metal halide lamp, both end portions of a ceramic arc tube have a smaller diameter than that of the central portion, electrically conductive lead-wires having an electrode at their tips are inserted at the both end portions, and the gap between the end portions of the arc tube and the conductive lead-wire is sealed with a sealing material Such conventional metal halide lamps using ceramic arc tubes have a well-known configuration in which high thermal resistance of a ceramic is used in order to enhance the lamp efficiency, thereby increasing the tube-wall load of the arc tube (lamp power per surface area of the entire arc tube) compared with metal halide lamps having a quartz arc tube.

As shown in FIG. 5, these metal halide lamps generally have electrodes having a structure in which the end face of an electrode coil 55 is positioned in the same plane as an electrode bar 54 (hereinafter, a flush structure will be referred to). Furthermore, there has been no detailed research about the relationship between the electrode structure and the occurrence of lamp flickering or the lifetime of lamps.

When compared with the metal halide lamp using a quartz arc tube, in the above-mentioned conventional metal halide lamp using a ceramic arc tube, it is possible to increase the tube-wall load of the arc tube and to realize high efficiency and high color rendition. On the other hand, since the temperature inside the arc tube is high and the electrode temperature is high, the deformation at the tip of the electrode is increased. As a result, the arc length is increased, which may lead to an increase in the lamp voltage, thus causing an early lamp break-off.

In the conventional metal halide lamp using ceramic arc tube, the shape of the tip of the electrode was optimized by employing the flush-structured electrode so as to reduce the increase in the arc length due to the deformation of the electrode tip, and suppress the lamp break-off.

On the other hand, in the conventional metal halide lamp having the flush-structured electrode, the rate of occurrence of lamp flickering is increased due to the movement of a discharge luminescent spot on the electrode coil. Furthermore, the discharge on the electrode coil is likely to occur, which may raise the temperature of the electrode coil locally. As a result, the evaporation of the electrode coil materials during the lifetime is increased, which may cause problems of blackening of the arc tube or reduction of the luminous flux maintenance factor.

SUMMARY OF THE INVENTION

It is an object of the present invention to provide a metal halide lamp in which the lamp flickering is reduced, the luminous flux maintenance factor during the lifetime is radically improved, and the lamp break-off is suppressed.

In order to achieve the above-mentioned objects, the metal halide lamp according to the present invention includes an arc tube of translucent ceramic in which a metal halide is filled; and a pair of electrodes provided in the arc tube, the electrode having an electrode bar and an electrode coil; wherein the following relationship is satisfied:

$$0.00056\times W+0.061\leqq\alpha\leqq0.0056\times W+1.61$$

where $\alpha$ (in mm) is a length of the portion of the electrode bar protruding from the end face of the electrode coil and W (in Watt) is the lamp power.

According to such a configuration, since the discharge luminescent spot is stable at the tip of the electrode bar and heat is released effectively by the electrode coil at the tip of the electrode bar, the increase in the lamp voltage and blackening of the arc tube are suppressed. Therefore, it is possible to provide a metal halide lamp with less lamp flickering, an improved flux maintenance factor and low possibility of lamp break-off.

It is preferable in the above-mentioned metal halide lamp that the ratio of sodium iodide with respect to the total amount of the metal halide is 10 wt % or more.

According to such a configuration, since the temperature inside the arc tube is reduced and thus the electrode temperature is reduced, the increase in the lamp voltage can be suppressed more effectively.

DETAILED DESCRIPTION OF THE INVENTION

Hereinafter, the present invention will be described by way of embodiments with reference to drawings.

First Embodiment

Figure 1:
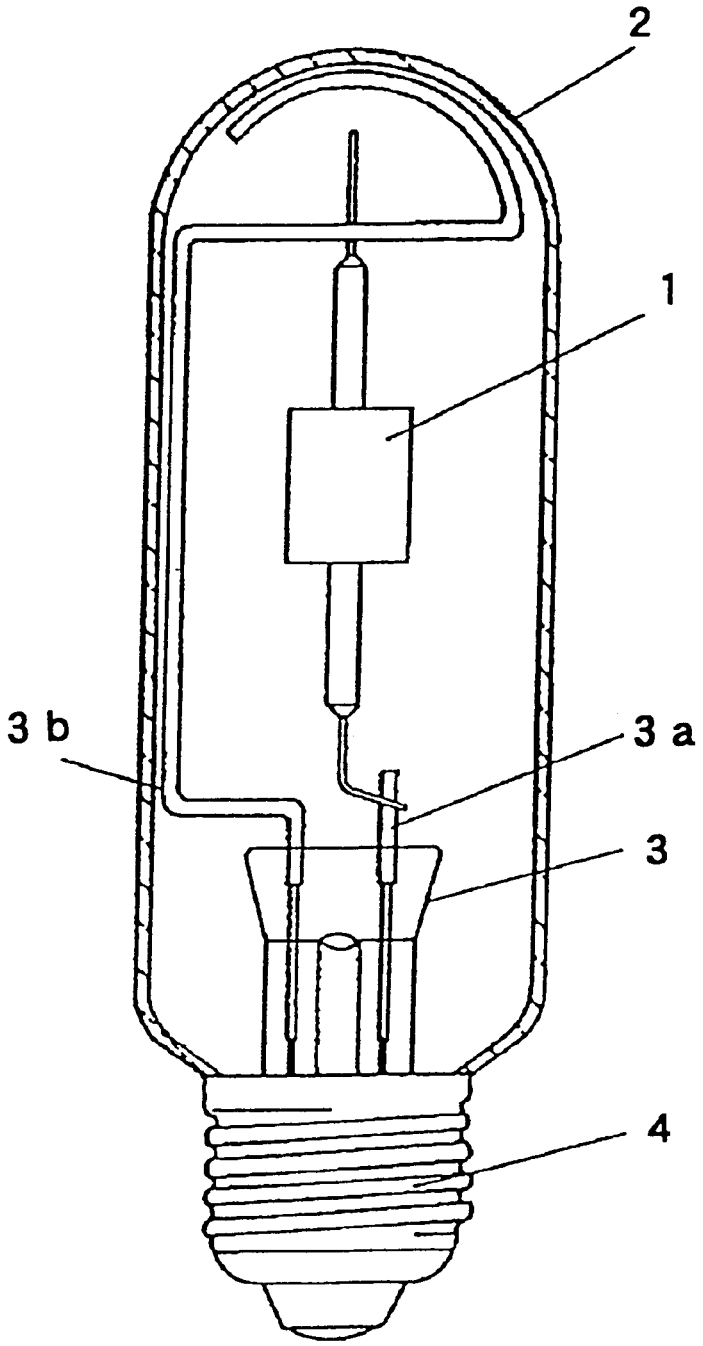
FIG. 1 is a partially cut-away front view showing a configuration of a metal halide lamp according to the embodiment of the present invention.

As shown in FIG. 1, a metal halide lamp according to a first embodiment of the present invention includes a translucent ceramic are tube 1 that is fixed and supported inside an outer tube 2 by metal wires 3*a* and 3*b*. The outer tube 2 is formed of a hard glass. Inside of the open portion of the outer tube 2, there is provided a stem 3 supporting the metal wires 3*a* and 3*b*. The stem 3 seals the outer tube 2 air-tightly. Furthermore, 350 Torr nitrogen is filled in the outer tube 2. The lamp base 4 is attached to the outside of the open portion of the outer tube 2. The lamp power of this metal halide lamp is 70 Watts.

Figure 2:
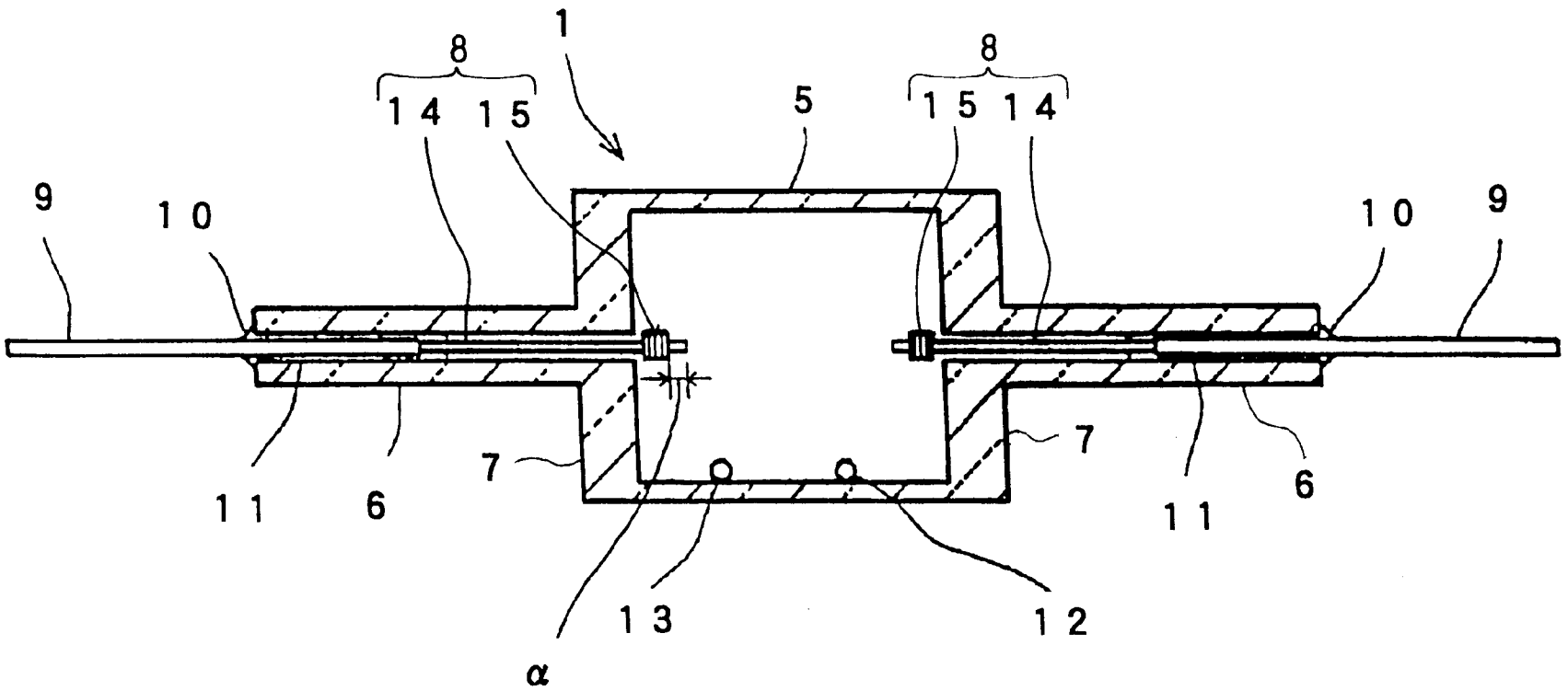
FIG. 2 is a cross-sectional view showing an arc tube of the metal halide lamp of FIG. 1.

Hereinafter, a configuration of the arc tube 1 will be described with reference to FIG. 2. As shown in FIG. 2, the arc tube 1 includes a main tube portion 5 and small tubular portions 6 provided at both ends of the main tube portion 5 having a cylindrical shape. The small tubular portion 6 has a smaller diameter than that of the main tube portion 5. The main tube portion 5 and the small tubular portions 6 are sintered coaxially into one piece with ring portions 7.

Lead wires 9 having an electrode 8 at the tip are respectively inserted into the small tubular portions 6 so that the electrodes 8 are positioned inside the main tube portion 5. The lead-in wires 9 are made of niobium having an outer diameter of 0.7 mm. The end of the small tubular portion 6 opposite to the ring portions 7 is sealed with a sealing material 10 inserted between the lead-in wire 9 and an inner wall of the small tubular portion 6 to form sealed portions 11.

The arc tube 1 is provided with a certain amount of mercury 12, a noble gas for a starting gas, and an iodide pellet 13 of metal halide. As the noble gas for the starting gas, argon is used. The iodide pellet 13 is a mixture of dysprosium iodide, thulium iodide, holmium iodide, thallium iodide, and sodium iodide.

Figure 3:
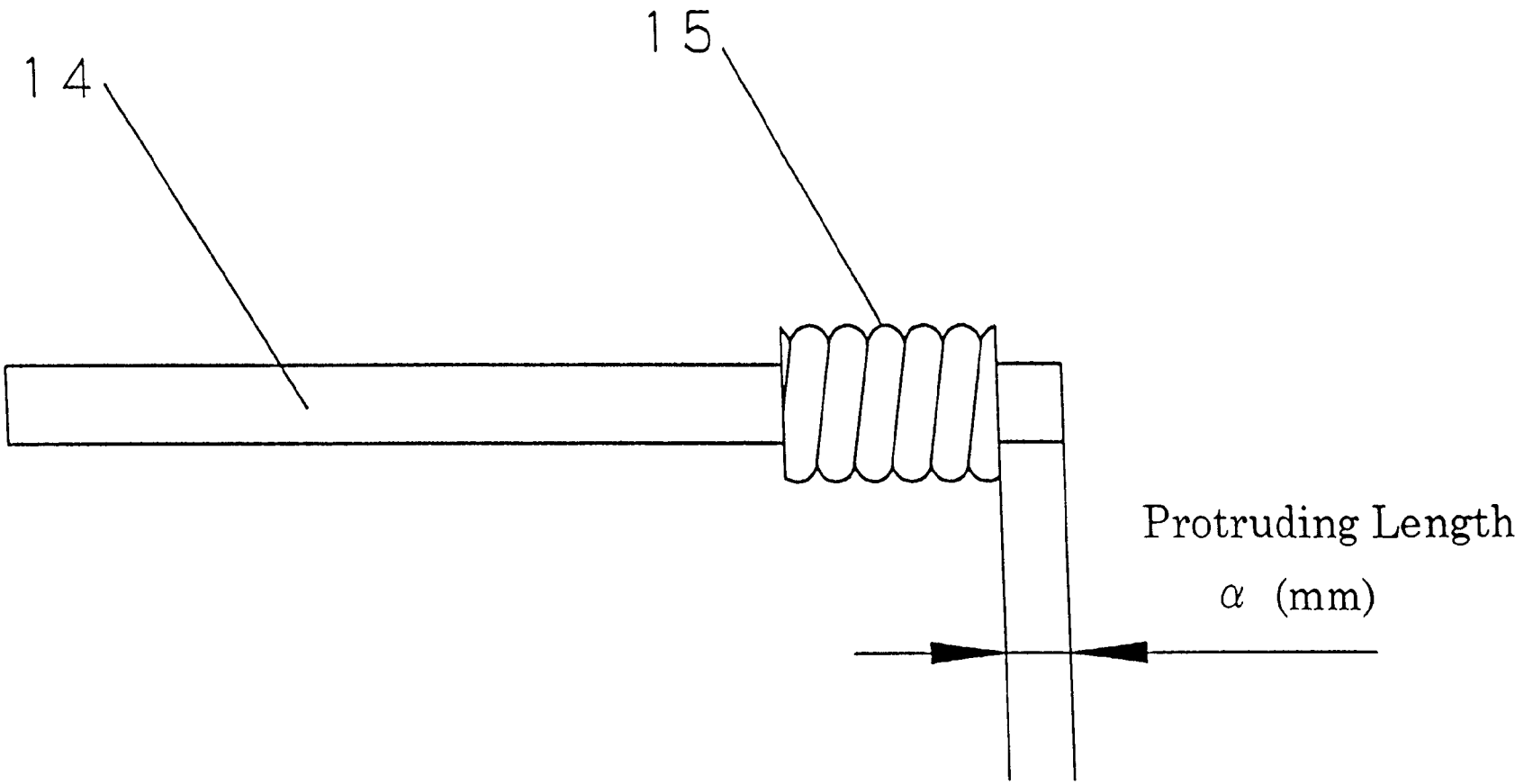
FIG. 3 is a plan view showing an electrode of the metal halide lamp of FIG. 1.

FIG. 3 shows a detailed structure of the electrode 8. As shown in FIG. 3, the electrode 8 includes a tungsten electrode bar 14 and an electrode coil 15. In the electrode 8, the electrode coil 15 is welded to the electrode bar 14 so that the electrode bar 14 protrudes from end face of the electrode coil 15 by a protruding length α (in mm).

Figure 5:
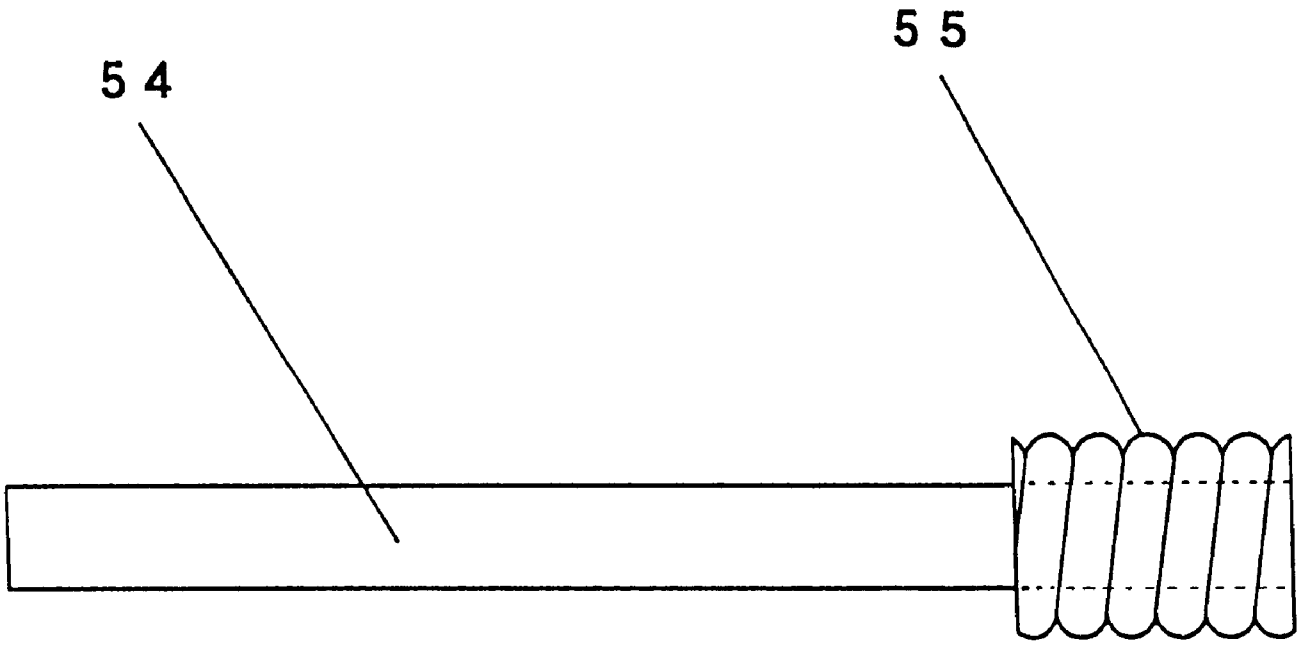
FIG. 5(PRIOR ART)
FIG. 5 is a plan view showing a configuration of a flush-structured electrode of a metal halide lamp of the prior art.

In the metal halide lamp having such a configuration, the occurrence of lamp flickering, luminous flux maintenance factor, and increase in the lamp voltage were examined while changing the protruding length α (in mm) of the electrode 8. Table 1 shows the results. In the uppermost row of Table 1, results of the conventional metal halide lamp having the flush-structured electrode illustrated in FIG. 5 are shown as a comparative example, where the protruding length α (in mm) of the electrode is 0 mm.

TABLE 1

| α (in mm) | Occurrence of lamp flickering | Luminous flux maintenance factor (with respect to 0 hr.) (%) | Increase in lamp voltage (V) | Evaluation |
|---|---|---|---|---|
| 0 (flush) | 3/10 | 68 | 12 | X |
| 0.05 | 2/10 | 70 | 12 | X |
| 0.1 | 0/10 | 84 | 14 | ○ |
| 0.25 | 0/10 | 87 | 15 | ○ |
| 0.5 | 0/10 | 86 | 15 | ○ |
| 0.75 | 0/10 | 86 | 16 | ○ |
| 1.0 | 0/10 | 85 | 17 | ○ |
| 1.25 | 0/10 | 85 | 18 | ○ |
| 1.5 | 0/10 | 84 | 20 | ○ |
| 1.75 | 0/10 | 84 | 22 | ○ |
| 2.0 | 0/10 | 83 | 24 | ○ |
| 2.25 | 0/10 | 81 | 26 | X |
| 2.5 | 0/10 | 80 | 29 | X |

In Table 1, the occurrence of lamp flickering is represented by the rate of the lamps in which the lamp flickering occurs during one hour of lamp operation. The luminous flux maintenance factor is represented by the ratio with respect to the flux value at the initial time of the lamp operation (i.e., the value at 0 hour lamp operation). The luminous flux maintenance factor and the increase in the lamp voltage are represented by the values after 2000 hours of lamp operation.

In the evaluation of the luminous flux maintenance factor, the case where the luminous flux maintenance factor is improved by 15% or more with respect to that of the comparative example shown in the uppermost row of Table 1, in which the protruding length a is 0 mm, is regarded as good and the other case outside the above-mentioned range is regarded as no-good. As is apparent from Table 1, it was confirmed that no lamp flickering occurred and the luminous flux maintenance factor could be improved by 15% or more when the protruding length a of the electrode 8 is 0.1 mm or more and 2.0 mm or less.

Furthermore, in the evaluation of the increase in the lamp voltage, the case where the lamp voltage is increased by less than 25V after 2000 hours of lamp operation is regarded as good, and the case where the lamp voltage is increased by 25V or more is regarded as no-good. This is because the increase in the lamp voltage by 25V or more after 2000 hours of lamp operation means, there is a high possibility of the lamp break-off in 6000 hours of lamp operation. According to this evaluation standard, it was confirmed from Table 1 that when the protruding length α (in mm) of the electrode 8 was 2.0 mm or less, the increase in the lamp voltage can be suppressed to less than 25V, thus suppressing the lamp break-off effectively.

From the above-mentioned result, it is seen that by setting the protruding length α (in mm) to be 0.1 mm or more, the discharge luminescent spot was stable at the tip of the electrode bar 14 and the lamp flickering and blackening of the arc tube were reduced. Furthermore, it is thought that by setting the protruding length a to be 2.0 mm or less, it was possible to release heat by the electrode coil 15 effectively at the tip of the electrode bar 14, thus suppressing the increase in the lamp voltage and the blackening of the arc tube.

Therefore, according to a comprehensive evaluation of the occurrence of lamp flickering, the luminous flux maintenance factor and increase in the lamp voltage, as marked with ○ in "Evaluation" column of Table 1, when the protruding length α (in mm) of the electrode 8 is set to be 0.1 mm or more and 2.0 mm or less, it is possible to obtain a 70 W metal halide lamp with less lamp flickering, extremely high luminous flux maintenance factor and the suppressed lamp break-off.

Figure 4:
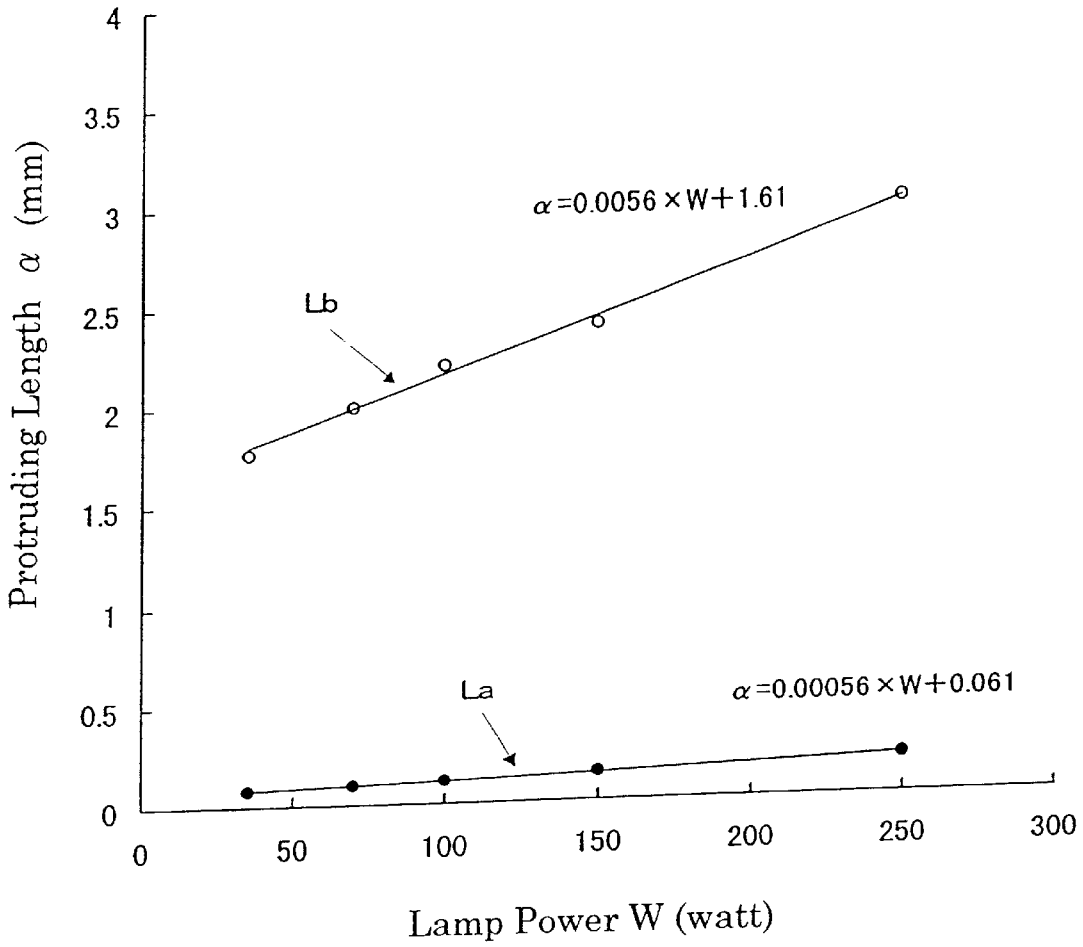
FIG. 4 is a graph showing the relationship between the lamp power and the length of the protruding portion of the electrode in the metal halide lamp of FIG. 1.

Moreover, the same examinations were performed for 35 W, 100 W, 150 W, and 250 W lamps to determine the upper and lower limits of the protruding length α (in mm) of the electrode 8 in which the luminous flux maintenance factor of the lamp can be improved by 15% or more, less lamp flickering occurs and the lamp break-off can be suppressed as compared with the conventional lamp having a flush-structured electrode as shown in FIG. 5. The results are shown in the graph of FIG. 4. In FIG. 4, the upper limit of the protrusion α (in mm) is marked with ○ and the lower limit is marked with ●.

It is confirmed from FIG. 4 that, in the above-mentioned lamps having various values of Watt, the protruding length α (in mm) of the electrode 8 should be in the range between the straight lines La and Lb in order to achieve less occurrence of lamp flickering and improvement of the luminous flux maintenance factor by 15% or more compared with the conventional lamp and capability of suppressing the lamp break-off.

A point (W, α) on the line La satisfies the following relation (1):

$$\alpha=0.00056\times W+0.061 \quad (1)$$

Furthermore, a point (W, α) on the line Lb satisfies the following relation (2):

$$\alpha=0.0056\times W+1.61 \quad (2)$$

In the range below the straight line La, the lamp flickering is not reduced and the luminous flux maintenance factor is not improved by 15% or more compared with conventional metal halide lamps. In the range above the straight line Lb, the luminous flux maintenance factor is not improved by 15% or more compared with conventional metal halide lamps and the lamp voltage is increased by 25V or more, and the lamp break-off during the lifetime may occur.

The following is thought to be a reason for it. When the protruding length a is taken in the range above the straight line La, the discharge luminous spot is stable at the tip of the electrode bar and the occurrence of lamp flickering and blackening in the arc tube were reduced. On the other hand, when the protruding length a is taken in the range below the straight line Lb, heat effectively can be released by the electrode coil at the tip of the electrode bar and the increase in the lamp voltage and blackening of the arc tube are suppressed.

In other words, when the following relation (3) is satisfied:

$$0.00056\times W+0.061\leqq\alpha\leqq0.0056\times W+1.61 \quad (3)$$

where α (in mm) denotes the protruding length of the electrode 8 and W (in Watt) denotes the lamp power, it is possible to obtain a metal halide lamp in which the occurrence of lamp flickering is reduced, the luminous flux maintenance factor is improved by 15% or more and the lamp break-off is suppressed as compared with conventional metal halide lamps having a flush-structured electrodes.

Second Embodiment

As shown in FIG. 1, a metal halide lamp according to a second embodiment of the present invention includes a translucent ceramic arc tube 1 that is fixed and supported inside an outer tube 2 by metal wires 3*a* and 3*b*. The outer tube 2 is formed of a hard glass. Inside of the open portion of the outer tube 2 is provided with a stem 3 supporting the metal wires 3*a* and 3*b*. The stem 3 seals the outer tube 2 air-tightly. Furthermore, 350 Torr of nitrogen is filled in the outer tube 2. A lamp base 4 is attached to the outside of the open portion of the outer tube 2. The lamp power of this metal halide lamp is 70 Watts.

Hereinafter, a configuration of the arc tube 1 will be described with reference to FIG. 2. As shown in FIG. 2, the arc tube 1 includes a main tube portion 5 and small tubular portions 6 provided at both ends of the main tube portion 5 having a cylindrical shape. The small tubular portion 6 has a smaller diameter than that of the main tube portion 5. The main tube portion 5 and the small tubular portions 6 are sintered coaxially into one piece with ring portions 7.

Lead wires 9 having an electrode 8 at the tip are respectively inserted into the small tubular portions 6 so that the electrodes 8 are positioned inside the main tube portion 5. The lead-in wires 9 are made of niobium having an outer diameter of 0.7 mm. The end of the small tubular portion 6 opposite to the ring portions 7 is sealed with a sealing material 10 inserted between the lead-in wire 9 and an inner wall of the small tubular portion 6 to form a sealed portions 11.

The arc tube 1 is provided with a certain amount of mercury 12, a noble gas for a starting gas, and iodide pellet 13 of metal halide. As the noble gas for the starting gas, argon is used. The iodide pellet 13 is a mixture of dysprosium iodide, thulium iodide, holmium iodide, thallium iodide, and sodium iodide.

FIG. 3 shows a detailed structure of the electrode 8. As shown in FIG. 3, the electrode 8 includes a tungsten electrode bar 14 and an electrode coil 15. In the electrode 8, the electrode coil 15 is welded to the electrode bar 14 so that the length α (in mm) of the electrode bar 14 protruding from the end face of the electrode coil 15 is 0.25 mm.

In the metal halide lamp having such a configuration of this embodiment, by changing the ratio of sodium iodide contained in the metal halide filled in the arc tube 1 as the iodide pellet 13, the increase in the lamp voltage was examined. Table 2 shows the results.

TABLE 2

| Rate of sodium iodide (wt. %) | Increase of lamp voltage (V) | Evaluation |
|---|---|---|
| 100 | 12 | ○ |
| 90 | 13 | ○ |
| 80 | 13 | ○ |
| 70 | 14 | ○ |
| 60 | 14 | ○ |
| 50 | 15 | ○ |
| 40 | 16 | ○ |
| 30 | 18 | ○ |
| 20 | 20 | ○ |
| 15 | 22 | ○ |
| 10 | 24 | ○ |
| 5 | 27 | X |
| 0 | 30 | X |

In Table 2, the increase in the lamp voltage is represented by the value measured after 2000 hours of lamp operation. In the evaluation of the increase in the lamp voltage, the case where the increase after 2000 hours of lamp operation is less than 25V is regarded as good and the case where the increase is 25V or more after 2000 hours of lamp operation is no-good. This is because the increase in the lamp voltage by 25V or more after 2000 hours of the lamp operation means there is a high possibility of the lamp break-off in 6000 hours of the lamp operation.

As is apparent from Table 2, it could be confirmed that when the rate of sodium iodide contained in the metal halide was 10 wt % or more, the increase of the lamp voltage was suppressed to less than 25V, thus suppressing the lamp break-off effectively.

In this way, when the rate of sodium iodide is 10 wt % or more, the temperature of the discharge arc inside the arc tube is lowered, the temperature at the tip of the electrode is lowered, and thus the increase in the lamp voltage due to the deformation of the electrode is reduced.

Therefore, when the rate of sodium iodide contained in the metal halide filled in the arc tube 1 as the iodide pellet 13 is set to be 10 wt % or more, it is possible to obtain a 70W metal halide lamp with the suppressed lamp break-off.

Moreover, when the same examinations were performed for 35 W, 100 W, 150 W, and 250 W lamps, it was confirmed that when the rate of sodium iodide contained in the metal halide filled in the arc tube 1 as the iodide pellet 13 is 10 wt % or more, the lamp break-off could be suppressed.

In the above-mentioned embodiment, the protruding length α (in mm) of the electrode 8 was 0.25 mm, but α is not necessary limited to this value. The same results can be obtained when α satisfies the following relation (3):

$$0.00056\times W+0.061\leqq\alpha\leqq0.0056\times W+1.61 \quad (3)$$

where W (in Watt) is the lamp power.

From the above-mentioned result, it is seen that when the relation (3) is satisfied:

$$0.00056\times W+0.061\leqq\alpha\leqq0.0056\times W+1.61 \quad (3)$$

where α (in mm) denotes a protruding length of the electrode 8 and W (in Watt) denotes the lamp power, and the rate of sodium iodide contained in the metal halide filled in the arc tube 1 is 10 wt % or more, it is possible to obtain a metal halide lamp with suppressed lamp break-off.

In the above-mentioned first and second embodiments, niobium wires were used for the lead-in wires 9 in the sealed portion 11. However, instead of niobium, other conductive materials with a thermal expansion coefficient that is close to the thermal expansion coefficient of the material of the arc tube 1 may be used for the lead-in wires. Moreover, conductive or non-conductive ceramic caps can be used for the sealed portion 11.

Furthermore, an arc tube in which the main tube portion 5 and the ring portion 7 are molded as one piece and further sintered into one piece with the small tubular portion 6 may be used as an arc tube 1. Furthermore, an arc tube in which the main tube portion 5, the small tubular portions 6 and the ring portions 7 are molded as one piece may be used as an arc tube 1.

Furthermore, in the first and second embodiments of the present invention, the outer tube 2 was filled with nitrogen gas, but it can also be filled with a gas mixture containing nitrogen. An example of a gas that can be mixed with nitrogen is, for example, neon (Ne). If the gas mixture containing nitrogen is used, it is preferable that the nitrogen gas accounts for at least 50 vol % of the gas mixture.

In addition, there is no particular limitation concerning the ceramic material used for the arc tube 1. For example, single-crystal metallic oxides such as sapphire, polycrystal metallic oxides such as alumina ($Al_2O_3$), yttrium-aluminum-garnet (YAG), and yttrium oxide (YOX), or polycrystal nonoxides such as aluminum nitrides (AlX), etc., can be used for the arc tube Moreover, hard glass has been used for the outer tube in the first and the second embodiments. However, there is no particular limitation concerning the outer tube, and any known material for such outer tubes can be used.

The invention may be embodied in other specific forms without departing from the spirit or essential characteristics thereof. The embodiments disclosed in this application are to be considered in all respects as illustrative and not restrictive, the scope of the invention being indicated by the appended claims rather than by the foregoing description, all changes that come within the meaning and range of equivalency of the claims are intended to be embraced therein.

What is claimed is:

1. A metal halide lamp comprising an arc tube of translucent ceramic, in which a metal halide is filled; and a pair of electrodes provided in said arc tube, each said electrode having an electrode bar and an electrode coil wrapped around the electrode bar;

wherein an end face of said electrode coil on the front end side of said electrode bar is shaped to form a plane substantially perpendicular to an axis of said electrode bar, and the following relationship is satisfied:

$$0.00056\times W+0.061\leqq\alpha\leqq0.0056\times W+1.61$$

where α is a length expressed in mm of a portion of said electrode bar protruding from the plane of the end portion of said electrode coil and W is the lamp power expressed in Watts.

2. The metal halide lamp according to claim 1, wherein the ratio of sodium iodide with respect to the total amount of said metal halide is 10 wt % or more.

3. A metal halide lamp comprising:

an outer tube, an arc tube of translucent ceramic provided within the outer tube, in which a metal halide is filled; and a pair of electrodes provided in said arc tube, each said electrode having an electrode bar and an electrode coil wrapped around the electrode bar;

wherein an end portion of said electrode coil on the front end side of said electrode bar is shaped to form a plane, the end face of the electrode bar uniformly protruding out of the electrode coil, such that the end portion of the electrode coil and the end face of the electrode bar are parallel, and the following relationship is satisfied:

$$0.00056\times W+0.061\leqq\alpha\leqq0.0056\times W+1.61$$

where α is a length expressed in mm of a portion of said electrode bar protruding from the plane of the end portion of said electrode coil and W is the lamp power expressed in Watts.

* * * * *